US005380641A

United States Patent [19]

Urabe et al.

[11] Patent Number: 5,380,641

[45] Date of Patent: Jan. 10, 1995

[54] PROCESS FOR THE PREPARATION OF SILVER HALIDE GRAINS

[75] Inventors: Shigeharu Urabe; Haruyasu Nakatsugawa; Mario Ishiyama, all of Kanagawa, Japan

[73] Assignee: Fuji Photo Film Co., Ltd., Kanagawa, Japan

[21] Appl. No.: 74,678

[22] Filed: Jun. 10, 1993

[30] Foreign Application Priority Data

Jun. 11, 1992 [JP] Japan ..... 4-152075

[51] Int. Cl.[6] ..... G03C 1/015

[52] U.S. Cl. ..... 430/569; 430/567

[58] Field of Search ..... 430/567, 569

[56] References Cited

U.S. PATENT DOCUMENTS 5,104,786 4/1992 Chronis et al. ..... 430/569
5,145,768 9/1992 Ichikawa et al. ..... 430/569
5,270,159 12/1993 Ichikawa et al. ..... 430/569

FOREIGN PATENT DOCUMENTS 0408752 7/1989 European Pat. Off. .

*Primary Examiner*—Janet C. Baxter
*Attorney, Agent, or Firm*—Sughrue, Mion, Zinn, Macpeak & Seas

[57] ABSTRACT

Disclosed is a novel process for the preparation of tabular silver halide grains having parallel twinning planes which comprises the steps of:

1) supplying an aqueous solution of a water-soluble silver salt, an aqueous solution of a water-soluble halide and an aqueous solution of a protective colloid into a mixing machine provided external to a reaction vessel where they are mixed to form nuclear grains; and
2) introducing the nuclear grains into a ripening vessel comprising a pipe where they are ripened at an elevated temperature.

12 Claims, 1 Drawing Sheet

PROCESS FOR THE PREPARATION OF SILVER HALIDE GRAINS

FIELD OF THE INVENTION

The present invention relates to a silver halide (hereinafter referred to as "AgX") emulsion used in the field of photography. More particularly, the present invention relates to a process for the preparation of tabular silver halide grains having parallel twinning planes and narrowly distributed grain sizes.

BACKGROUND OF THE INVENTION

In the prior art process which has heretofore been commonly used to prepare tabular AgX grains, nucleation, ripening and growth are effected in one tank (a so-called batch process). This process has two disadvantages.

First, in order to prepare tabular grains having narrowly distributed sizes, the duration of nucleation is preferably short. However, when the duration of nucleation is shortened, the amount of added solutes is reduced, reducing the yield of an AgX emulsion. If the rate of addition is raised in an attempt to make up for the reduction in the amount of added solutes, high concentration solute solutions must be added at a great flow rate. This creates the problem that agitation and mixing speed cannot keep up with the flow rate, particularly in mass production.

Second, in the nucleation and ripening procedures, nuclear grains which have been formed early and grains which have been formed later are mixed with each other, causing physical ripening therebetween and resulting in a wider size distribution. Further, in the nucleation procedure, nuclei which have been formed early undergo physical ripening and grain growth, while those formed later undergo less physical ripening and grain growth. This also widens the size distribution of tabular AgX grains.

In order to eliminate these disadvantages, various improvements have been attempted in the tank process. However, none of these attempts has been successful. For example, JP-A-2-838 (the term "JP-A" as used herein means an "unexamined published Japanese patent application") discloses in its example a nucleation duration of 5 seconds to 10 minutes at a temperature of 30° C. EP 0,362,69A2 discloses the addition of a silver salt solution to the system in 2 seconds to form nuclei. However, such a technique is infeasible in mass production as mentioned above. The aforementioned problems cannot be solved at the same time in the batch process. As a process other than the batch process, European Patent 0408752A1 discloses a process which comprises continuously supplying to a high temperature reaction vessel finely divided grains formed in a mixing vessel provided external to the reaction vessel, and then immediately causing ripening reaction to effect nucleation reaction. However, since nuclei which have been introduced early into the reaction vessel and those which have been introduced later have different histories, and since both these grains are ripened at the same time, uniformity is reduced.

U.S. Pat. No. 5,104,786 discloses adding a silver salt solution to an aqueous solution containing a halide and passing a protective colloid through a pipe to effect nucleation. In this process, it is true that nuclear grains thus formed advantageously have the same history. However, since the aqueous solution of silver salt and the aqueous solution of halide are mixed in a fine pipe, turbulence needs to occur in the pipe, requiring a large amount of liquid to flow in the fine pipe. The mixing in a pipe attains a lower mixing efficiency than that obtained by general agitators. Therefore, the concentration of the solution to be added must be minimized to a relatively low value. This inevitably means that the yield of the emulsion will be reduced. Further, this patent provides no improvement in the uniformity of the history of various grains in the ripening procedure, and the ripening procedure is still batch-wise.

SUMMARY OF THE INVENTION

It is therefore an object of the present invention to provide a process for the preparation of tabular emulsion grains having narrowly distributed grain sizes in a high yield mass production.

It is another object of the present invention to provide a process for the continuous preparation of an emulsion of tabular seed crystals or finely divided tabular grains having a narrow grain size distribution.

These and other objects of the present invention will become more apparent from the following detailed description and examples.

These objects of the present invention are accomplished by the following embodiments of the present invention:

(1) A process for the preparation of tabular silver halide grains having parallel twinning planes via at least a nucleation step and a subsequent ripening step, which process comprises effecting nucleation and ripening in a mixing machine and a ripening vessel, respectively, which are provided external to a reaction vessel which allows the grains to grow, and then introducing the grains into the reaction vessel where they are allowed to grow, in accordance with the following steps:

1) supplying an aqueous solution of a water-soluble silver salt, an aqueous solution of a water-soluble halide and an aqueous solution of a protective colloid into a mixing machine provided external to a reaction vessel, where they are mixed to form nuclear grains;

2) introducing the nuclear grains into a ripening vessel comprising a pipe where they are ripened at an elevated temperature; and 3) introducing the ripened grains into the reaction vessel equipped with an agitator where they are allowed to grow.

(2) A process for the preparation of tabular silver halide grains having parallel twinning planes only via a nucleation step and a ripening step, which comprises effecting nucleation and ripening in a mixing machine and a ripening vessel, respectively, in accordance with the following steps:

1) supplying an aqueous solution of a water-soluble silver salt, an aqueous solution of a water-soluble halide and an aqueous solution of a protective colloid into a mixing machine provided external to said reaction vessel, where they are mixed to form nuclear grains; and 2) introducing the nuclear grains into a ripening vessel comprising a pipe where they are ripened at an elevated temperature.

(3) A process for the preparation of tabular silver halide grains having parallel twinning planes via at least a nucleation step and a subsequent ripening step, which comprises effecting nucleation and ripening in a mixing machine and a ripening vessel provided external to a reaction vessel, and then adding an emulsion thus obtained to said reaction vessel as an emulsion of tabular silver halide seed grains, in accordance with the following steps:

1) supplying an aqueous solution of a water-soluble silver salt, an aqueous solution of a water-soluble halide and an aqueous solution of a protective colloid into a mixing machine provided external to said reaction vessel, where they are mixed to form nuclear grains;
2) introducing the nuclear grains into a ripening vessel comprising a pipe where they are ripened at an elevated temperature; and
3) cooling and storing the ripened grains.

(4) The process for the preparation of tabular silver halide grains according to any of embodiments (1) to (3) above, wherein the duration in which said aqueous solution of silver salt, said aqueous solution of halide and said aqueous solution of protective colloid are present in said mixing machine is 20 seconds or less as determined by the following equation:

$$t=v/(a+b+c)$$

wherein t represents the residence time of the added solutions in the mixing machine; v represents the volume (ml) of the mixing machine; a represents the volume (ml/min) of the added silver salt solution; b represents the volume (ml/min) of halide solution; and c represents the volume (ml/min) of the added protective colloid solution.

BRIEF DESCRIPTION OF THE DRAWINGS

By way of example and to make the description more clear, reference is made to the accompanying drawings.

DETAILED DESCRIPTION OF THE INVENTION

The present invention will be further described hereinafter.

(A) Tabular AgX Emulsion Grains

The term "tabular AgX emulsion grains" as used herein means emulsion grains wherein grains having two or three parallel twinning planes account for 75% or more of all grains, preferably grains having two parallel twinning planes account for 85% or more, more preferably 95% or more, and most preferably 98% or more of all grains, as calculated in terms of projected area. For the details of the structure of these tabular grains, reference can be made to E. Klein, H. J. Meltz, and E. Moisar, *Phot. Korr.*, vol. 99, pp. 99–102, 1963, vol. 100, pp. 57–71, 1964, and J. E. Maskasky, *Journal Imaging Science*, vol. 31, pp. 15–26, 1987.

The present invention provides a process for the preparation of monodispserse tabular emulsion grains having narrowly distributed sizes in mass production. The term "monodisperse" as used herein means the state of having a fluctuation coefficient [(standard deviation of grain size distribution/average grain diameter in terms of projected area of circle)×100%] of preferably 36% or less, more preferably 25% or less, further preferably 15% or less. The halogen composition of AgX is not specifically limited. AgCl, AgBr, AgI or a mixed crystal of two or more of these halides can be used as AgX. More preferably, AgBrI ($I^-$ content is in the range of 0 to solid solution limit, preferably 0 to 25 mol %, more preferably 0 to 15 mol %) may be used. The aspect ratio of grain is in the range of 1 or more, preferably 2 or more, more preferably 4 to 20.

The term "aspect ratio" as used herein indicates the diameter/thickness ratio of tabular grain. The term "diameter" as used herein indicates the diameter of the circle having the same area as the projected area of grain determined under an electron microscope. The term "thickness" as used herein indicates the distance between the main planes of tabular grain.

In order to obtain tabular AgX grains having an excellent monodispersibility and narrowly distributed sizes, it is necessary to go through at least a nucleation procedure and a subsequent ripening procedure. In this case, twinning planes are formed in the nucleation procedure, and grains other than tabular grains are extinguished in the ripening procedure. In the prior art process, both nucleation and ripening are effected in a reaction tank or nucleation is effected outside the reaction tank and ripening is then effected in the reaction tank. In the present invention, both nucleation and ripening are continuously effected outside a reaction tank. In this regard, the present invention quite differs from the prior art processes and is a novel and epoch-making process for the preparation of fine monodisperse tabular grains.

Figure 1:
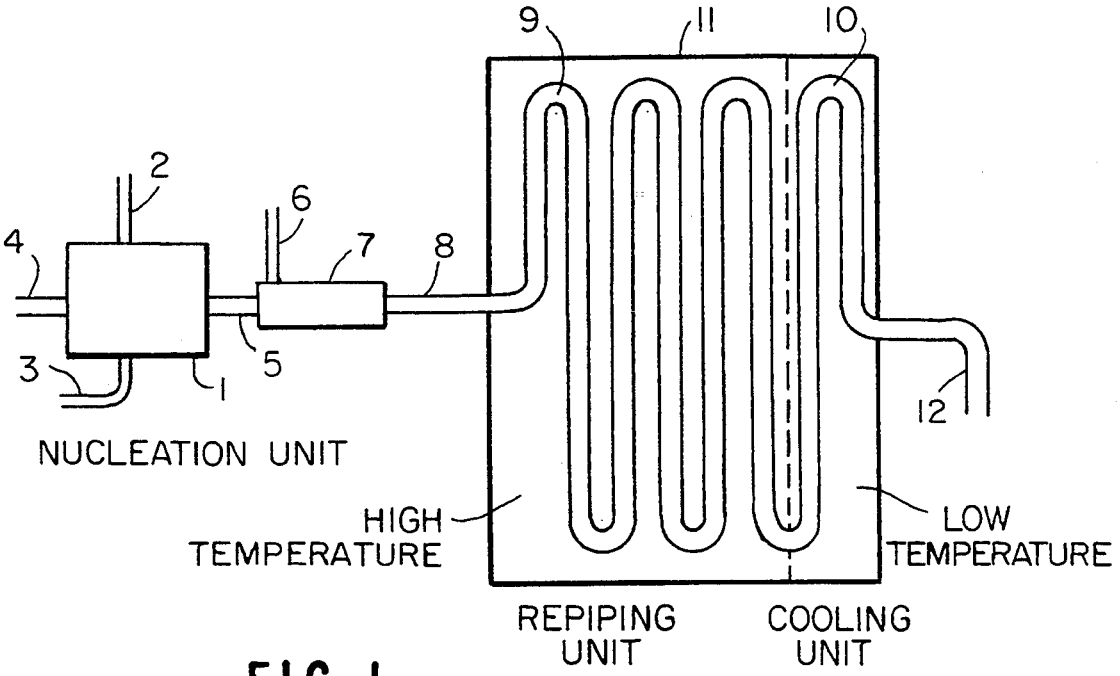
FIG. 1 is a schematic view of a system for use in the preparation process according to the present invention.

A system for use in the process for the preparation of tabular AgX grains according to the present invention is illustrated in FIG. 1. As shown in FIG. 1, the system of the present invention comprises a nucleation unit and a ripening unit. In operation, a silver salt solution, a halide solution and a protective colloid solution are introduced into a mixing machine 1 through the respective addition systems 2, 3 and 4. The aqueous solution of protective colloid may be optionally introduced into the system in admixture with the aqueous solution of halide and/or aqueous solution of silver salt.

In the mixing machine, these solutions are rapidly and vigorously mixed, and the resulting nuclear grains are then discharged through a pipe 5. As necessary, a silver salt solution or halide solution may be added to the system through an addition system 6 to adjust the pH value of the nuclear emulsion. (Further, an AgX solution or other additives may be added to the system as necessary.)

These materials are mixed with the nuclear emulsion by a static mixer 7, and then introduced into the ripening unit through a pipe 8. The ripening unit comprises a constant temperature bath 11 and a ripening pipe 9. The nuclear emulsion enters through the pipe 8 into the ripening pipe where it can be ripened at a rapidly elevated temperature. While moving through the high temperature ripening pipe, the nuclear emulsion is ripened, dissolving grains other than tabular grains away. The emulsion which has been ripened (containing tabular grains alone) is passed through a cooling pipe 10 to lower its temperature, and then discharged through a discharge pipe 12.

The subsequent procedures can be conducted in the following manner depending on the purpose:

1) If the grains are required to continue to grow:

The tabular emulsion grains which have been ripened are introduced into a reaction tank equipped with an agitator until a predetermined amount of grain is reached. An aqueous solution of silver salt and an aqueous solution of halide are then added to the reaction tank to allow the grains to grow.

2) If a tabular seed grain emulsion for use in the grain growth is obtained:

i. The tabular emulsion grains which have been ripened are cooled, and then introduced into a tank where they are stored at a low temperature; or ii. The tabular emulsion grains which have been ripened are cooled, introduced into a tank, desalted, and then stored at a low temperature. Specifically, desalting is effected by decantation with a flocculating agent, ultrafiltration, decantation with a modified gelatin, decantation with an inorganic salt or by a combination thereof. The temperature to which the grains are cooled is 30° C. or lower, preferably 10° C. or lower. The period during which the grains are stored is not limited. The grains may be used as seed grains to the system in the reaction vessel as necessary.

3) If finely divided tabular grains are obtained:

The same procedure as described in case 2) can be used. In this case, the process consists only of a nucleation step and a ripening step. After the completion of desalting, chemical sensitization can continue to be effected.

Figure 2:
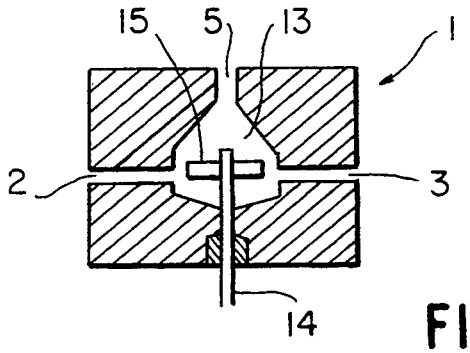
FIG. 2 is a cross-sectional view of the mixing machine of FIG. 1, wherein reference numeral 1 indicates a mixing machine, reference numerals 2, 3, 4 and 6 indicate addition pipes, reference numerals 5 and 8 indicate transport pipes, reference numeral 7 indicates a static mixier, reference numeral 9 indicates a ripening pipe, reference numeral 10 indicates a cooling pipe, reference numeral 11 indicates a constant temperature bath, reference numeral 12 indicates a discharge pipe, reference numeral 13 indicates a reaction chamber, reference numeral 14 indicates a rotary shaft, and reference numeral 15 indicates an agitating element.

FIG. 2 illustrates a detailed view of the mixing machine 1. Provided inside the mixing machine 1 is a reaction chamber 13 in which an agitating element 15 mounted on a rotary shaft 14 is provided. An aqueous solution of silver salt, an aqueous solution of halide, and an aqueous solution of protective colloid are introduced into the reaction chamber 13 through three inlets (2, 3, and one not shown, respectively). By rotating the rotary shaft 14 at a high speed (1,000 r.p.m. or more, preferably 2,000 r.p.m. or more, more preferably 3,000 r.p.m. or more), these aqueous solutions can be rapidly and vigorously mixed.

New ideas in the preparation process of the present invention are as follows.

In the formation of tabular grains, tabular grains are mixed with other grains, e.g., regular crystal grains, single twin grains and cubic twin having nonparallel twinning planes during nucleation. Accordingly, it is important to dissolve these undesirable grains away by ripening. In order to obtain monodisperse and uniform tabular grains, it is very important that these grains experience the same history via these procedures. In the prior art tank processes, grains which have been early formed and those which have been later formed are present together, making it impossible for these grains to experience the same history. In the present invention, after nucleation is completed in a relatively short period of time, the emulsion is transported through a pipe until it is completely ripened. Thus, there is no chance that grains having different histories are mixed with each other.

In order to embody the aforementioned principle of the present invention, the following factors may be taken into account:

i. The nucleation time should be minimized. In other words, it is important that nuclear grains which have been formed at different times are not mixed with each other in the mixing machine for nucleation. Accordingly, in the present invention, it is desirable that the residence time in the mixing machine be short. The following conditions are preferably observed. The residence time of solutions introduced into the mixing machine for nucleation can be represented by the following equation:

$$t=v/(a+b+c)$$

v: volume (ml) of the reaction chamber in the mixing machine;

a: added amount (ml/min) of silver nitrate solution;

b: added amount (ml/min) of halide solution; and c: added amount (ml/min) of protective colloid solution In the preparation process of the present invention, the residence time t is 20 seconds or less, preferably 10 seconds or less, more preferably 2 seconds or less. Thus, grains which have been formed at different times are discharged immediately after nucleation without being mixed with each other.

ii. Introduction of an aqueous solution of protective colloid into the mixing machine.

The introduction of an aqueous solution of protective colloid into the mixing machine is conducted in the following manner:

a. An aqueous solution of protective colloid is singly introduced into the mixing machine.

b. A protective colloid is incorporated in an aqueous solution of halide.

c. A protective colloid is incorporated in an aqueous solution of silver nitrate.

In processes a to c, the concentration of protective colloid is in the range of 0.2% or more, preferably 1% or more. The aforementioned processes a to c may be employed, singly or simultaneously. As the protective colloid of the present invention gelatin may be normally used, preferably low molecular gelatin (average molecular amount: 40,000 or less). This is because although nucleation is preferably effected at a temperature as low as possible in the present invention, a low molecular gelatin does not set even at a low temperature. Further, hydrophilic colloids other gelatin may be also used. The nucleation temperature is preferably low and is 60° C. or lower, preferably 50° C. or lower, more preferably 5° C. to 40° C.

iii. The retention of emulsion is not allowed until the ripening is completed. The emulsion which has been discharged from the mixing machine is transported through a pipe without being retained until the ripening is completed as shown in FIG. 1. By adjusting the length of the pipe passing through the constant temperature bath and the inner diameter of the pipe, the ripening time can be adjusted. In order to prevent the emulsion from bubbling during transportation, the pipe may be inclined so that the emulsion can be transported upward. The ripening temperature is 40° C. or higher, preferably 50° C. or higher, more preferably 60° C. to 95° C.

iv. The completion of ripening in a short period of time is important in the light of production time. In this regard, a ripening agent is used in the present invention. A bromide or chloride may be used. A bromide may be added to the system to adjust the pBr value of the emulsion to 3.5 or less, preferably 2.5 or less, more preferably 1 to 2. Further, a silver halide solvent may be used as a ripening agent.

Examples of such a silver halide solvent include thiocyanate, ammonia, thioether, and thiourea.

Specific examples of such a silver halide solvent include the thiocyanates described in U.S. Pat. Nos. 2,222,264, 2,448,534, and 3,320,069, ammonia, the thioether compounds described in U.S. Pat. Nos. 3,271,157, 3,574,628, 3,704,130, 4,297,439, and 4,276,347, the thione compounds described in JP-A-53-144319, JP-A-53-82408, and JP-A-55-77737, the amine compounds described in JP-A-54-100717, the thiourea derivatives described in JP-A-55-2982, the imidazoles described in JP-A-54-100717, and the substituted mercaptotetrazoles described in JP-A-57-202531.

Such a ripening agent may be introduced into the system through the addition system 6 in FIG. 1.

Thus, the present invention can provide a continuous preparation of monodisperse tabular fine AgX grains. The average grain diameter of the tabular grains is normally in the range of 1.0 μm or less, preferably 0.1 μm to 0.8 μm, more preferably 0.1 μm to 0.5 μm as calculated in terms of projected area. The thus obtained emulsion of small-sized tabular grains can be directly desalted by ultrafiltration or may be desalted by decantation with an ordinary flocculating agent or by salting-out. The emulsion which has been desalted may be subsequently subjected to chemical sensitization or spectral sensitization.

The thus obtained emulsion of small-sized tabular grains may be subsequently allowed to grow to obtain tabular AgX grains having the desired size and halogen composition and a larger size. The grain growth may be conventionally effected by introducing an aqueous solution of silver salt and an aqueous solution of halide into a reaction vessel. Alternatively, the grain growth may be effected by introducing an emulsion of finely divided AgX grains which has been previously prepared into the reaction vessel. The two methods may be used in combination. Further, the method described in JP-A-1-186931 may be used.

The tabular grains obtained according to the present invention and tabular grains obtained by allowing the grains to grow further may be subjected to chemical sensitization. That is, chemical sensitization with a sulfur, selenium, tellurium compound, a gold compound or a compound of a group VIII noble metal (e.g., complex compound of Pt, Ir, Pd), singly or in combination, preferably chemical sensitization with a combination of gold, sulfur and selenium compounds, reduction sensitization with stannous chloride, thiourea dioxide, polyamine, an amineborane compound, etc. may be conducted.

The tabular grains obtained according to the present invention and tabular grains obtained by allowing the grains to grow further may be subjected to spectral sensitization.

The spectral sensitizing dye to be used in the present invention may be normally a methine dye. Examples of such a methine dye include a cyanine dye, a melocyanine dye, a composite cyanine dye, a composite melocyanine dye, a holopolar cyanine dye, a hemicyanine dye, a styryl dye, and a hemioxonol dye. Any of the nuclei which are commonly used as basic heterocyclic nuclei for cyanine dyes can be applied to these dyes. Examples of suitable nuclei which can be applied to these dyes include a pyrroline nucleus, an oxazoline nucleus, a thiazoline nucleus, a pyrrole nucleus, an oxazole nucleus, a thiazole nucleus, a selenazole nucleus, an imidazole nucleus, a tetrazole nucleus, a pyrridine nucleus, and a nucleus obtained by fusion of alicyclic hydrocarbon rings to these nuclei or nuclei obtained by fusion of aromatic hydrocarbon rings to these groups, e.g., an indolenine nucleus, a benzindolenine nucleus, an indole nucleus, a benzoxazole nucleus, a naphthoxazole nucleus, a benzothiazole nucleus, a naphthothiazole nucleus, a benzoselenazole nucleus, a benzimidazole nucleus and a quinoline nucleus. These nuclei may contain substituents on their carbon atoms.

Examples of suitable nuclei which can be applied to melocyanine dye or composite melocyanine dye include those having a ketomethylene structure such as a 5- or 6-membered heterocyclic nucleus, e.g., a pyrazoline-5-one nucleus, a thiohydantoin nucleus, a 2-thiooxazoline-2,4-dione nucleus, a thiazolidine-2,4-dione nucleus, a rhodanine nucleus, and a thiobarbituric acid nucleus.

Such a sensitizing dye may be added to the system before or after chemical ripening. For the silver halide grains of the present invention, such a sensitizing dye may be added to the system during or before chemical ripening (e.g., during nucleation, physical ripening).

As the high molecular compound which serves as the protective colloid for the silver halide grains to be used in the present invention there may be used the following compounds:

a. Polyacrylamide polymers

Examples of such polyacrylamide polymers include homopolymers of acrylamide, the copolymers of polyacrylamide and imidized polyacrylamide disclosed in. U.S. Pat. No. 2,541,474, the copolymers of acrylamide and methacrylamide disclosed in West German Patent 1,202,132, the partially aminated acrylamide. polymers disclosed in U.S. Pat. No. 3,284,207, the substituted acrylamide polymers disclosed in JP-B-45-14031 (the term "JP-B" as used herein means an "examined Japanese patent publication"), U.S. Pat. Nos. 3,713,834, and 3,746,548, and British Patent No. 788,343.

b. Amino polymers

Examples of such amino polymers include the amino polymers disclosed in U.S. Pat. Nos. 3,345,346, 3,706,504, and 4,350,759, and West German Patent 2,138,872, the polymers containing quaternary amines disclosed in British Pat. No. 1,413,125, and U.S. Pat. No. 3,425,836, the polymers containing amino groups and carboxyl groups disclosed in U.S. Pat. No. 3,511,818, and the polymers disclosed in U.S. Pat. No. 3,832,185.

c. Polymers containing thioether groups

Examples of such polymers include polymers containing thioether groups as disclosed in U.S. Pat. Nos. 3,615,624, 3,860,428, and 3,706,564.

d. Polyvinyl alcohols

Examples of such polyvinyl alcohols include homopolymers of vinyl alcohol, the organic acid monoesters of polyvinyl alcohol disclosed in U.S. Pat. No. 3,000,741, the maleic esters disclosed in U.S. Pat. No. 3,236,653, and the copolymers of polyvinyl alcohol and polyvinyl pyrrolidone disclosed in U.S. Pat. No. 3,479,189.

e. Acrylic polymers

Examples of such acrylic polymers include acrylic homopolymers, the acrylic ester polymers containing amino groups disclosed in U.S. Pat. Nos. 3,832,185, and 3,852,073, the halogenated acrylic ester polymers disclosed in U.S. Pat. No. 4,131,471, and the cyanoalkylacrylic esters disclosed in U.S. Pat. No. 4,120,727.

f. Polymers containing hydroxyquinoline

Examples of such polymers include the polymers containing hydroxyquinoline disclosed in U.S. Pat. Nos. 4,030,929, and 4,152,161.

g. Cellulose, starch

Examples of such cellulose and starch include the cellulose and starch derivatives disclosed in British Patents 542,704, and 551,659, and U.S. Pat. Nos. 2,127,573, 2,311,086, and 2,322,085.

h. Acetals

Examples of such acetal include the polyvinyl acetals disclosed in U.S. Pat. Nos. 2,358,836, 3,003,879, and 2,828,204, and British Patent 771,155.

i. Polyvinyl pyrrolidones

Examples of such polyvinyl pyrrolidones include homopolymers of vinyl pyrrolidone, and the copolymers of acrolein and pyrrolidone disclosed in French Patent 2,031,396.

j. Polystyrenes

Examples of such polystyrenes include the polystyrylamine polymers disclosed in U.S. Pat. No. 4,315,071, and the halogenated styrene polymers disclosed in U.S. Pat. No. 3,861,918.

k. Terpolymers

Examples of such terpolymers include the terpolymerized polymers of acrylamide, acrylic acid and vinyl imidazole disclosed in JP-B-43-7561, and German Patents 2,012,095, and 2,012,970.

l. Others

Other examples of polymers include the vinyl polymers containing azaindene groups disclosed in JP-A-59-8604, the polyalkylene oxide derivatives disclosed in U.S. Pat. No. 2,976,150, the polyvinylamine imide polymers disclosed in U.S. Pat. No. 4,022,623, the polymers disclosed in U.S. Pat. Nos. 4,294,920, and 4,089,688, the polyvinyl pyridines disclosed in U.S. Pat. No. 2,484,456, the vinyl polymers containing imidazole groups disclosed in U.S. Pat. No. 3,520,857, the vinyl polymers containing triazole groups disclosed in JP-B-60-658, the polyvinyl-2-methylimidazole and acrylamideimidazole copolymers disclosed in *Journal of Society of Photographic Science and Technology of Japan,* vol. 29, No. 1, page 18, dextran, and the water-soluble polyalkylene aminotriazoles disclosed in *Zeitschrift Wissenschaftlicher Photographie,* vol. 45, page 43 (1950).

In the present invention, a low molecular gelatin may be used. The average molecular weight of such a gelatin is preferably in the range of 40,000 or less, more preferably 20,000 or less.

The low molecular gelatin to be used in the present invention can be normally prepared in the following manner. A commonly used gelatin having an average molecular weight of 100,000 is dissolved in water. A gelatin decomposition enzyme is then added to the solution so that the gelatin molecule is enzymatically decomposed. For this process, reference can be made to R. J. Cox., *Photographic Gelatin II,* Academic Press, London, 1976, pp. 233–251 and pp. 335–346.

In this process, the connecting position at which the enzyme acts to decompose is predetermined, advantageously obtaining a low molecular gelatin having a relatively narrow molecular distribution. In this case, the longer the enzymatic decomposition time is, the smaller is the molecular weight of the gelatin. In an alternate process, the gelatin solution is heated in an atmosphere of a low pH (1 to 3) or high pH (10 to 12) to effect hydrolyzation.

The use of the aforementioned synthetic protective colloids, natural protective colloids and low molecular gelatins enables the formation of finely divided silver halide grains at a temperature of 35° C. or lower, even 30° C. or lower, providing a perfect solution to the problems caused by the use of ordinary gelatins as protective colloids.

The photographic emulsion to be used in the present invention can comprise various compounds for the purpose of inhibiting fogging during the preparation, storage or photographic processing of the light-sensitive material or for the purpose of stabilizing the photographic properties. In particular, there can be used many compounds known as fog inhibitors or stabilizers. Examples of these fog inhibitors or stabilizers include azoles such as benzothiazolium salts, nitroindazoles, triazoles, benzotriazoles and benzimidazoles (particularly nitro- or halogen-substituted benzimidazoles); heterocyclic mercapto compounds such as mercaptothiazoles, mercaptobenzothiazoles, mercaptobenzimidazoles, mercaptothiadiazoles, mercaptotetrazoles (particularly 1-phenyl-5-mercaptotetrazole) and mercaptopyrimidines; the aforementioned heterocyclic mercapto compounds containing water-soluble groups such as a carboxyl group and a sulfon group; thioketo compounds such as oxazolinethione, azaindenes such as tetraazaindenes (particularly 4-hydroxy-substituted (1,3,3a,7)-tetazaindenes); benzenethiosulfonic acids; and benzenesulfinic acids.

These fog inhibitors or stabilizers may be normally added to the system after the completion of chemical sensitization. More preferably, the time of addition of these fog inhibitors or stabilizers may be during chemical ripening or may be at any time before the beginning of chemical ripening.

The emulsion of the present invention may be used in photographic light-sensitive materials having an arbitrary layer configuration regardless of whether the emulsion layer consists of a single layer or two or more layers.

A silver halide multi-layer color photographic material comprising the emulsion of the present invention has a multi-layer configuration obtained by superimposing emulsion layers containing a binder and silver halide grains for separately recording blue, green and red lights. The various emulsion layers each comprises at least two layers, i.e., a high sensitivity layer and a low sensitivity layer.

The silver halide emulsion of the present invention may be applied to color photographic light-sensitive materials as mentioned above. The silver halide emulsion of the present invention may be similarly applied to other photographic light-sensitive materials such as X-ray light-sensitive material, black-and-white light-sensitive material, plate-making light-sensitive material and photographic paper, regardless of whether the emulsion layer consists of a single layer or a plurality of layers.

Various additives to be incorporated into the silver halide emulsion of the present invention, such as a binder, a chemical sensitizer, a spectral sensitizer, a stabilizer, a gelatin hardener, a surface active agent, a polymer latex, a matting agent, a color coupler, an ultraviolet absorbent, a discoloration inhibitor and a dye, the support for photographic light-sensitive material comprising such an emulsion, the coating method, the exposure method, the development process, etc. are not specifically limited. For the details of these items, reference can be made to *Research Disclosure* (RD) Item 17643, vol. 176, Item 18716, vol. 187, and Item 22534, vol. 225 as shown in a table below.

| Kind of additive | RD17643 | RD18716 | RD22534 |
|---|---|---|---|
| 1. Chemical sensitizer | p. 23 | p. 648 right column (RC) | p. 24 |
| 2. Sensitivity increasing agent | | p. 648 right column (RC) | |
| 3. Spectral sensitizer and supersensitizer | pp. 23–24 | p. 648 RC–p. 649 RC | p. 24–28 |
| 4. Brightening agent | p. 24 | | |
| 5. Antifoggant and stabilizer | pp. 24–25 | p. 649 RC | p. 24, 31 |
| 6. Light absorbent, filter dye, and ultraviolet absorbent | pp. 25–26 | p. 649 RC–p. 650 LC | |
| 7. Stain inhibitor | p. 25 RC | p. 650 LC–RC | |
| 8. Dye image stabilizer | p. 25 | | p. 32 |
| 9. Hardening agent | p. 26 | p. 651 LC | p. 28 |
| 10. Binder | p. 26 | " | |
| 11. Plasticizer and lubricant | p. 27 | p. 650 RC | |
| 12. Coating aid and surface active agent | pp. 26–27 | " | |
| 13. Antistatic agent | p. 27 | " | |
| 14. Color coupler | p. 25 | p. 649 | p. 31 |

The color coupler to be used in the present invention preferably contains a ballast group or is polymerized to exhibit nondiffusibility. A two-equivalent coupler in which the coupling-active position is substituted by a coupling-off group is preferred to a four-equivalent coupler in which the coupling-active position has a hydrogen atom in the light of reduction of the coated amount of silver. Further, a coupler which can provide a developed dye having a proper diffusibility, a noncoloring coupler, or a DIR coupler which releases a development inhibitor upon a coupling reaction or coupler which releases a development accelerator upon a coupling reaction may be used.

A typical example of the yellow coupler which can be used in the present invention is an oil protect type acylacetamide coupler.

Typical examples of such an oil protect type acylacetamide coupler include yellow couplers having oxygen atom-linked coupling-off groups and yellow couplers having nitrogen atom-linked coupling-off groups. α-Pivaloylacetanilide couplers are excellent in fastness of the developed dye, particularly to light. On the other hand, α-benzoylacetanilide couplers can provide a high color density.

Examples of magenta couplers which can be used in the present invention include oil protect type indazolone or cyanoacetyl, preferably 5-pyrazolone couplers, and pyrazoloazole couplers such as pyrazolotriazoles. As such a 5-pyrazolone coupler there may be preferably used such a coupler which is substituted by an arylamino group or amylamino group at the 3-position in the light of color hue and color density of developed dyes.

In light of the lack of subsidiary yellow absorption by developed dyes and the light fastness of developed dyes, the imidazo[1,2-b]pyrazoles described in U.S. Pat. No. 4,500,630 are preferably used. The pyrazolo[1,5-b][1,2,4]triazoles described in U.S. Pat. No. 4,540,650 are particularly preferred.

Examples of the cyan couplers which can be used in the present invention include oil protect type naphtholic and phenolic couplers. Typical examples of such cyan couplers include the naphtholic couplers described in U.S. Pat. No. 2,474,293. Preferred examples of such naphtholic couplers include the two-equivalent naphtholic couplers having oxygen atom-linked coupling-off groups described in U.S. Pat. Nos. 4,052,212, 4,146,396, 4,228,233, and 4,296,200.

The cyan couplers which are substituted by a sulfonamide group, amide group or the like at the 5-position of naphthol described in JP-A-60-237448, JP-A-61-153640 and JP-A-61-145557 are excellent in the fastness of developed image and may be preferably used in the present invention.

A coupler which can provide a developed dye having a proper diffusibility may be used in combination with these couplers to improve the graininess of the photographic light-sensitive material. Specific examples of such a coupler include the magenta couplers disclosed in U.S. Pat. No. 4,366,237 and British Patent 2,125,570, and the yellow, magenta and cyan couplers disclosed in EP96,570 and West German Patent Application Disclosure No. 3,234,533.

The present invention may include a coupler which releases a development inhibitor upon development, i.e., so-called DIR coupler.

Preferred examples of DIR couplers to be combined with the present invention include the developer-deactivating type DIR couplers exemplified in JP-A-57-151944, the timing type DIR couplers exemplified in U.S. Pat. No. 4,248,962 and JP-A-57-154234, and the reactive type DIR couplers exemplified in Japanese Patent Application No. 59-39653. Particularly preferred among these DIR couplers are the developer-deactivated DIR couplers disclosed in JP-A-57-151944 and JP-A-58-217932, and JP-A-60-218644, JP-A-60-225156, and JP-A-60-233649, and the reactive type DIR couplers disclosed in JP-A-60-184248.

The photographic light-sensitive material of the present invention may comprise a compound which releases imagewise a nucleating agent or development accelerator or precursor thereof (hereinafter referred to as "development accelerator") upon development. Typical examples of such a compound include couplers which undergo a coupling reaction with an oxidation product of an aromatic primary amine developing agent to release a development accelerator or the like, i.e., so-called DAR couplers as described in British Patents 2,097,140, and 2,131,188.

Specific examples of a high boiling organic solvent to be used in the dispersion of a color coupler include phthalic esters (e.g., dibutyl phthalate, dicyclohexyl phthalate, di-2-ethylhexyl phthalate, decyl phthalate), phosphoric or phosphonic esters (e.g., triphenyl phosphate, tricresyl phosphate, 2-ethylhexyl diphenyl phosphate, tricyclohexyl phosphate, tri-2-ethylhexyl phosphate, tridecyl phosphate, tributoxy phosphate, tributoxyethyl phosphate, trichloropropyl phosphate, di-2-ethylhexylphenyl phosphonate), benzoic esters (e.g., 2-ethylhexyl benzoate, dodecyl benzoate, 2-ethylhexyl-p-hydroxybenzoate), amides (e.g., diethyldodecanamide, N-tetradecylpyrrolidone), alcohols or phenols (e.g., isostearyl alcohol, 2,4-di-tert-amylphenol), aliphatic carboxylic esters (e.g., dioctyl azerate, glycerol tributylate, isostearyl lactate, trioctyl citrate), aniline derivatives (N,N-dibutyl-2-butoxy-5-tert-octylaniline), and hydrocarbons (e.g., paraffin, dodecylbenzene, diisopropyl naphthalene).

As an auxiliary solvent there may be used an organic solvent having a boiling point of about 30° C. or higher, preferably 50° C. to about 160° C. Typical examples of such an organic solvent include ethyl acetate, butyl acetate, ethyl propionate, methyl ethyl ketone, cyclohexanone, 2-ethoxyethyl acetate, and dimethylformamide.

As a gelatin hardener there may be preferably used an active halogen compound (e.g., 2,4-dichloro-6-hydroxy-1,3,5-triazine, sodium salt thereof) or an active vinyl compound (e.g., 1,3-bisvinylsulfonyl-2-propanol, 1,2-bis(vinylsulfonylacetamide)ethane, vinyl polymer having vinylsulfonyl group in its side chain), which rapidly hardens a hydrophilic colloid such as gelatin to give stable photographic properties.

N-carbamoylpyridinium salts (e.g., 1-morpholinocarbonyl-3-pyridinio)methanesulfonate) and haloamidinium salts (e.g., 1-(1-chloro-1-pyridinomethylene)pyrrolidinium-2-naphthalenesulfonate) are other examples of gelatin hardeners which provide an advantageously high curing speed.

Color photographic light-sensitive materials comprising the silver halide photographic emulsion of the present invention which have been developed and blixed or fixed are normally subjected to washing or stabilization.

The washing procedure is normally effected in a countercurrent process in which the washing water flows backward through two or more baths to save water. As the stabilization procedure there can be typically used a multi-stage countercurrent stabilization process as disclosed in JP-A-57-8543 instead of a washing procedure.

The color developer to be used in the development of the present light-sensitive material is preferably an alkaline aqueous containing as a main component an aromatic primary amine color developing agent. As such a color developing agent there can be effectively used an aminophenolic compound. In particular, p-phenylenediamine compounds are preferably used. Typical examples of such p-phenylenediamine compounds include 3-methyl-4-amino-N,N-diethylaniline, 3-methyl-4-amino-N-ethyl-N-$\beta$-hydroxyethylaniline, 3-methyl-4-amino-N-ethyl-N-$\beta$-methanesulfonamidoethylaniline, 3-methyl-4-amino-N-ethyl-N-$\beta$ -methoxyethylaniline, and sulfates, hydrochlorides and p-toluenesulfonates thereof. These compounds can be used in combination of two or more thereof depending on the purpose of the application.

Reversal processing is usually carried out by black-and-white development followed by color development. Black-and-white developers to be used can contain one or more of known black-and-white developing agents, such as dihydroxybenzenes, e.g., hydroquinone; 3-pyrazolidones, e.g., 1-phenyl-3-pyrazolidone; and aminophenols, e.g., N-methyl-p-aminophenol.

The color developer or black-and-white developer usually has a pH of from 9 to 12. The replenishment rate of the developer is usually 3 l or less per $m^2$ of the light-sensitive material, depending on the type of the color photographic material to be processed. The replenishment rate may be reduced to 500 ml/$m^2$ or less by decreasing the bromide ion concentration in the replenisher.

The photographic emulsion layer which has been color-developed is normally subjected to bleaching. Bleaching may be effected simultaneously with fixation (i.e., blix), or these two steps may be carried out separately. For speeding up of processing, bleaching may be followed by blix. In particular, aminopolycarboxylic acid-iron (III) complex salts are useful in both a bleaching solution and a blix solution. The pH value of a bleaching solution or blix solution comprising such an aminopolycarboxylic acid-iron complex salts is normally in the range of 5.5 to 8. For speeding up processing, the processing can be effected at an even lower pH value.

The bleaching bath, blix bath or a prebath thereof can contain, if desired, a bleaching accelerator. As useful bleaching accelerators there may be preferably used compounds containing a mercapto group or a disulfide group. In particular, the compounds described in U.S. Pat. No. 3,893,858, West German Patent 1,290,812, and JP-A-53-95630 are preferred. The compounds disclosed in U.S. Pat. No. 4,552,834 are also preferred. These bleaching accelerators may be incorporated into the light-sensitive material.

It is usual that the thus desilvered silver halide color photographic material of the invention are subjected to washing and/or stabilization. The quantity of water to be used in the washing can be selected from a broad range depending on the characteristics of the light-sensitive material (for example, the kind of couplers, etc.), the end use of the light-sensitive material, the temperature of washing water, the number of washing tanks (number of stages), the replenishment system (e.g., counter-flow system or forward-flow system), and other various factors. Of these factors, the relationship between the number of washing tanks and the quantity of water in a multistage counterflow system can be obtained according to the method described in *Journal of the Society of Motion Picture and Television Engineers*, vol. 64, pp. 248–253 (May 1955).

The present invention will be further described in the following examples, but the present invention should not be construed as being limited thereto.

EXAMPLE 1

Tabular Grain Emulsion 1-A <comparative>

To 2.0 l of a 0.8 wt % low molecular (molecular weight: 10,000) gelatin solution containing 0.05M potassium bromide were added 50 cc of a 1.0M silver nitrate solution and 50 cc of a 1.0M potassium bromide solution with stirring by double jet process over 50 seconds. During this procedure, the gelatin solution was kept at 40° C. After this procedure, the system was heated to a temperature of 75° C. 220 cc of a 10% gelatin solution was then added to the system. The material was then ripened at a temperature of 75° C. for 20 minutes. 80 cc of a 0.47M silver nitrate solution was added to the material.

After 10 minutes, 150 g of silver nitrate was added to the system at an accelerated rate (the flow rate at the end of addition was 19 times that at the beginning of addition) over 60 minutes. During this 60 minute procedure, the pBr value of the system was kept at 2.55. The emulsion was cooled to 35° C., washed by an ordinary flocculation process, adjusted to pH 6.5 and pAg 8.6 at 4° C., and then stored in a cool and dark place. The tabular grains thus obtained had a diameter fluctuation coefficient of 22% as calculated in terms of a circle having the same projected area as the grain, a diameter of 1.4 μm as calculated in terms of the circle, and an average thickness of 0.15 μm.

Tabular Grain Emulsion 1-B <present invention>

In the system shown in FIG. 1, a 0.4M silver nitrate solution and a solution containing 0.4M potassium bromide and 1 wt % of a low molecular gelatin (molecular amount: 10,000) were introduced into a mixing machine at a rate of 500 cc/min, respectively, to effect nucleation. The volume of the mixing machine was 35 cc. The rate of stirring was 5,000 r.p.m. The temperature was 30° C. Under these conditions, the residence time of added solutions in the mixing machine was 2 seconds, and the potential in the mixing machine was kept at −15 mv (reference electrode: saturated calomel electrode). The ripening following the nucleation was conducted in a ripening pipe. The ripening time (the residence time of the nuclear emulsion in the ripening pipe) was 10 minutes. The ripening temperature was 75° C. The nuclear emulsion which has been discharged from the ripening unit was introduced into a reaction vessel containing 2.0 l of an aqueous solution containing 0.05M potassium bromide which had been kept at 75° C. for 20 seconds (333 cc of the nuclear emulsion was added). Subsequently, grain growth was effected at pBr 2.55 as in Example 1. The emulsion was then washed with water. The tabular grains thus obtained had a diameter fluctuation coefficient of 16% as calculated in terms of the circle mentioned above, a diameter of 1.4 μm as calculated in terms of the circle, and an average thickness of 0.16 μm.

The aforementioned results show that the present invention can provide monodisperse tabular grains having a narrower distribution of grain sizes. Further, Emulsion 1-A and Emulsion 1-B were each subjected to optimum chemical sensitization with sodium thiosulfate and sodium chloroaurate. These emulsions were each coated on a support in an amount of 2 g/m$^2$. These specimens were each exposed to blue light for 0.1 second, and then developed with the following metholascorbic acid developer at a temperature of 20° C. for 10 minutes. As a result, assuming that the relative sensitivity of Comparative Emulsion 1-A was 100, Emulsion 1-B of the present invention exhibited a sensitivity of 120. Further, Emulsion 1-B exhibited a higher gradation than Emulsion 1-A.

| Methol-ascorbic acid developer (per l) | |
|---|---|
| Methol | 2.5 g |
| L-ascorbic acid | 10.0 g |
| Borax | 35 g |
| Potassium bromide | 1.0 g |

EXAMPLE 2

Seed Emulsion 2-A (comparative)

To 10 l of a 0.8 wt % low molecular gelatin (molecular amount: 15,000) containing 0.08M potassium bromide were added 500 cc of a 1.0M silver nitrate solution and 500 cc of a 1.0M potassium bromide solution by double jet process with stirring over 40 seconds. During this procedure, the gelatin solution was kept at 30° C. After this procedure, the material was heated to a temperature of 75° C. To the material was added 300 g of a deionized alkali-treated bone gelatin. The emulsion was then ripened for 30 minutes. The emulsion was then rinsed by an ordinary flocculation process. The emulsion was then redispersed at a temperature of 40° C. to obtain a seed emulsion of tabular grains.

Seed Emulsion 2-B (present invention)

In the system shown in FIG. 1, a 0.5M silver nitrate solution and a solution containing 0.5M potassium bromide and 2 wt % of a low molecular gelatin (molecular amount: 15,000) were introduced into a mixing machine at a rate of 1,500 cc/min, respectively, to effect nucleation. The volume of the mixing machine was 100 cc. The rate of stirring was 6,000 r.p.m. The temperature was 30° C. Under these conditions, the residence time of added solutions in the mixing machine was 2 seconds, and the potential in the mixing machine was kept at −10 mv.

The ripening following the nucleation was continuously conducted in a ripening pipe. The ripening time was 5 minutes. The ripening temperature was 80° C. The nuclear emulsion which has been cooled to a temperature of 35° C. via the ripening unit and the cooling unit was stocked in a stock tank, washed with water by an ordinary method, and then redispersed to obtain a seed emulsion of tabular grains.

Tabular Grain Emulsion 2-C (comparative)

A tenth of Seed Emulsion 2-A was dissolved in 1 l of a 3 wt % aqueous solution of an alkali-treated bone gelatin. A silver nitrate solution and a potassium bromide solution were then added to the emulsion at a temperature of 75° C. with pBr being kept at 2.4 to effect grain growth. The emulsion was cooled to 35° C. and then rinsed by an ordinary flocculation process. The tabular grains thus obtained had a diameter of 1.5 μm and a diameter fluctuation coefficient of 21% as calculated in terms of the circle mentioned above.

Tabular Grain Emulsion 2-D (present invention)

Three hundred cc of the seed emulsion 2-B was measured out. The seed emulsion was then allowed to undergo grain growth as in Emulsion 2-C. The tabular grains thus obtained had a diameter of 1.4 μm and a diameter fluctuation coefficient of 16% as calculated in terms of the circle mentioned above. The aforementioned results show that the present invention can provide monodisperse tabular grains having a narrower distribution of grain size. Further, Emulsion 2-C and Emulsion 2-D were each subjected to optimum chemical sensitization with sodium thiosulfate and sodium chloroaurate as in Example 1. These emulsions were each coated on a film and then subjected to senitometry as in Example 1. As a result, assuming that the relative sensitivity of comparative Emulsion 2-C was 100, Emulsion 2-D of the present invention exhibited a sensitivity of 110. Emulsion 2-D also exhibited a higher gradation than Emulsion 2-C.

EXAMPLE 3

The present example relates to fine tabular grains.

Emulsion 3-A <comparative>

To 100 l of a 0.7 wt % low molecular (molecular weight: 20,000) gelatin solution containing 0.08M potassium bromide were added 10 of a 2.0M silver nitrate solution and 10 l of a 2.0M potassium bromide solution with stirring by double jet process over 2 minutes. During this procedure, the gelatin solution was kept at 45° C. After this procedure, the system was heated to a temperature of 70° C. 2.0 kg of a deionized gelatin was then added to the system. The material was then ripened for 30 minutes. After the ripening, the emulsion was washed by an ordinary flocculation process and then redispersed at a temperature of 40° C. The fine tabular grains thus obtained had a diameter of 0.4 μm and a diameter fluctuation coefficient of 35% as calculated in terms of the circle mentioned, and an average thickness of 0.06 μm.

Emulsion 3-B <present invention>

In the system shown in FIG. 1, a 0.5M silver nitrate solution and a solution containing 0.5M potassium bromide and 2 wt % of a low molecular gelatin (molecular amount: 20,000) were introduced into a mixing machine at a rate of 1,500 cc/min, respectively, to effect nucleation. The volume of the mixing machine was 80 cc. The rate of stirring was 4,000 r.p.m. The temperature was 30° C. Under these conditions, the residence time of the added solutions in the mixing machine is 1.6 seconds, and the potential in the mixing machine was kept at −20 mv. The ripening following the nucleation was continuously conducted in a ripening pipe at a ripening temperature of 75° C. The ripening time (the residence time of the nuclear emulsion in the ripening pipe) was 10 minutes. The nuclear emulsion which had been cooled via the ripening unit and the cooling unit was washed with water by an ordinary flocculation process. The system of the present invention can be continuously operated for 26 minutes to obtain Emulsion 3-B containing silver in the same amount as for Emulsion 3-A. The tabular grains thus obtained had an average diameter of 0.35 μm and a diameter fluctuation coefficient of 25% as calculated in terms of the circle mentioned, and an average thickness of 0.06 μm.

The aforementioned results show that the present invention can provide monodisperse fine tabular grains having a narrower distribution of grain size.

The present example shows that the advantage of the present invention is not only to obtain monodisperse grains but also to prepare an emulsion by means of a small-sized apparatus in a short period of time. In other words, in the case of Emulsion 3-A, it took 62 minutes to prepare the emulsion by means of a 100-l reaction vessel (reaction tank) (addition: 2 min.; temperature rise: 30 min.; ripening: 30 min.; total: 62 min.). On the contrary, in the present invention, it took only about 30 minutes to prepare a fine emulsion in the same amount as above by means of a mixing machine having a volume of only 80 cc and a ripening apparatus comprising a pipe alone. This shows that the present invention is effective in saving time and space.

Further, the fine tabular grains obtained in the present example can be used as seed emulsion because they are used to obtain tabular grains having a larger size. In other words, as shown in Example 2, a predetermined amount of a fine emulsion of tabular grains may be introduced into a reaction vessel where an aqueous solution of silver salt and an aqueous solution of halide may then be added. Since the preparation of a seed emulsion according to the present invention is continuously effected, it is obviously very effective to prepare silver halide emulsion grains on a larger scale. In other words, the preparation process of the present invention does not require a large tank as in a batch process. It may require only a relatively small mixing machine and a ripening unit.

Further, Emulsion 3-A and Emulsion 3-B were each subjected to optimum chemical sensitization with sodium thiosulfate and sodium chloroaurate as in Example 1. These emulsions were each coated on a film and then subjected to sensitometry as in Example 1. As a result, assuming that the relative sensitivity of Comparative Emulsion 3-A was 100, Emulsion 3-B of the present invention exhibited a sensitivity of 110. Emulsion 3-B also exhibited a higher gradation than Emulsion 3-A.

The formation of tabular AgX grains consists of nucleation and ripening. In these procedures, if grains occuring early and those occuring later are mixed with each other, the size distribution of grains thus obtained is widened. Therefore, the prior art batch process using a reaction vessel cannot avoid such a problem. This problem can be solved only by the present invention. In other words, the present invention can provide monodisperse tabular grains without substantially mixing new and old grains in both the nucleation and ripening steps.

Further, the present invention can provide a continuous preparation of monodisperse tabular grains. This enables the preparation of a large amount of tabular grains by mass production without using a large-sized apparatus as in a batch process.

Moreover, the present invention enables a high efficient preparation of a monodisperse emulsion of large size grains by allowing the small size tabular grains thus obtained to grow as seed emulsion directly or after being stored.

While the invention has been described in detail and with reference to specific embodiments thereof, it will be apparent to one skilled in the art that various changes and modifications can be made therein without departing from the spirit and scope thereof.

What is claimed is:

1. A process for the preparation of tabular silver halide grains having parallel twinning planes via at least a nucleation procedure and a subsequent ripening procedure, which comprises effecting nucleation and ripening in a mixing machine and a ripening vessel provided external to a reaction vessel, and then introducing said grains into said reaction vessel where they are allowed to grow, in accordance with the following procedures:

1) supplying an aqueous solution of a water-soluble silver salt, an aqueous solution of a water-soluble halide and an aqueous solution of a protective colloid into a mixing machine provided external to said reaction vessel where they are mixed at a temperature of 5° C. to 40° C. to form nuclear grains;
2) introducing said nuclear grains into a ripening vessel comprising a pipe where they are ripened at an elevated temperature of 50° C. to 95° C. with the ripening being completed in the ripening vessel; and
3) introducing said ripened grains into said reaction vessel equipped with an agitator where they are allowed to grow;

wherein grains formed at different times in the mixing machine are not mixed with each other in the ripening vessel.

2. The process for the preparation of tabular silver halide grains according to claim 1, wherein the residence time in which said aqueous solution of silver salt, said aqueous solution of halide and said aqueous solution of protective colloid are present in said mixing machine is 20 seconds or less as determined by the following equation:

$$t=v/(a+b+c)$$

wherein t represents the residence time of added solutions in the mixing machine; v represents the volume (ml) of the mixing machine; a represents the volume (ml/min) of added silver salt solution; b represents the volume (ml/min) of halide solution; and c represents the volume (ml/min) of protective colloid solution.

3. The process for the preparation of tabular silver halide grains according to claim 1, wherein a second aqueous solution of a water-soluble silver salt and a second aqueous solution of a water-soluble halide are introduced into the reaction vessel.

4. The process for the preparation of tabular silver halide grains according to claim 1, wherein the average grain diameter of the tabular grains produced is 1.0 μm or less.

5. A process for the preparation of tabular silver halide grains having parallel twinning planes said process consisting essentially of a nucleation procedure and a ripening procedure, which comprises effecting nucleation and ripening in a mixing machine and a ripening vessel, respectively, in accordance with the following steps:

1) supplying an aqueous solution of a water-soluble silver salt, an aqueous solution of a water-soluble halide and an aqueous solution of a protective colloid into a mixing machine where they are mixed at a temperature of 5° C. to 40° C. to form nuclear grains; and
2) introducing said nuclear grains into a ripening vessel comprising a pipe where they are ripened at an elevated temperature of 50° C. to 95° C. with the ripening being completed in the ripening vessel;

wherein the grains formed at different times in the mixing machine are not mixed with each other in the ripening vessel.

6. The process for the preparation of tabular silver halide grains according to claim 5, wherein the residence time in which said aqueous solution of silver salt, said aqueous solution of halide and said aqueous solution of protective colloid are present in said mixing machine is 20 seconds or less as determined by the following equation:

$$t=v/(a+b+c)$$

wherein t represents the residence time of added solutions in the mixing machine; v represents the volume (ml) of the mixing machine; a represents the volume (ml/min) of added silver salt solution; b represents the volume (ml/min) of halide solution; and c represents the volume (ml/min) of protective colloid solution.

7. The process for the preparation of tabular silver halide grains according to claim 5, wherein the average grain diameter of the tabular grains produced is 1.0 μm or less.

8. A process for the preparation of tabular silver halide grains having parallel twinning planes via at least a nucleation procedure and a subsequent ripening procedure, which comprises effecting nucleation and ripening in a mixing machine and a ripening vessel provided external to a reaction vessel, and then adding the emulsion thus obtained to the system in said reaction vessel as an emulsion of tabular silver halide seed grains, in accordance with the following steps:

1) supplying an aqueous solution of a water-soluble silver salt, an aqueous solution of a water-soluble halide and an aqueous solution of a protective colloid into mixing machine provided external to said reaction vessel where they are mixed at a temperature of 5° C. to 40° C. to form nuclear grains;
2) introducing said nuclear grains into a ripening vessel comprising a pipe where they are ripened at an elevated temperature of 50° C. to 95° C. with the ripening being completed in the ripening vessel;
3) cooling and storing the ripened groups; and
4) adding said ripened grains as an emulsion of seed grains to said reaction vessel;

wherein the grains formed at different times in the mixing machine are not mixed with each other in the ripening vessel.

9. The process for the preparation of tabular silver halide grains according to claim 8, wherein the residence time in which said aqueous solution of silver salt, said aqueous solution of halide and said aqueous solution of protective colloid are present in said mixing machine is 20 seconds or less as determined by the following equation:

$$t=v/(a+b+c)$$

wherein t represents the residence time of added solutions in the mixing machine; v represents the volume (ml) of the mixing machine; a represents the volume (ml/min) of added silver salt solution; b represents the volume (ml/min) of halide solution; and c represents the volume (ml/min) of protective colloid solution.

10. The process for the preparation of tabular silver halide grains according to claim 8, wherein the storing of the ripened grains occurs in a tank and is at a low temperature.

11. The process for the preparation of tabular silver halide grains according to claim 10, wherein the stored grains are desalted in the tank.

12. The process for the preparation of tabular silver halide grains according to claim 8, wherein the average grain diameter of the tabular grains produced is 1.0 μm or less.

* * * * *